United States Patent [19]

Gmohling

[11] 4,194,902

[45] Mar. 25, 1980

[54] DESULFURIZATION AGENT FOR FERROUS MELTS AND METHOD OF USING THE SAME

[75] Inventor: Werner Gmohling, Hufschlag, Fed. Rep. of Germany

[73] Assignee: SKW Trostberg Aktiengesellschaft, Trostberg, Fed. Rep. of Germany

[21] Appl. No.: 941,659

[22] Filed: Sep. 12, 1978

[30] Foreign Application Priority Data

Sep. 15, 1977 [DE] Fed. Rep. of Germany ..... 2741588

[51] Int. Cl.[2] ..... C21C 7/02

[52] U.S. Cl. ..... 75/55; 75/53; 75/58

[58] Field of Search ..... 75/53, 58, 55

[56] References Cited

U.S. PATENT DOCUMENTS

| | | | |
|---|---|---|---|
| 3,055,753 | 9/1962 | Matuschkovitz | 75/58 |
| 3,099,552 | 7/1963 | Landig | 75/55 |
| 3,598,573 | 8/1971 | Freissmuth | 75/55 |
| 3,929,464 | 12/1975 | Todd | 75/58 |

*Primary Examiner*—Peter D. Rosenberg

*Attorney, Agent, or Firm*—Curtis, Morris & Safford

[57] ABSTRACT

Improved desulfurization of ferrous melts is obtained by injecting into the melt in finely divided form a mixture by weight 48% to 95% calcium carbide, 2% to 40% of carbon-containing calcium carbonate and from about 1% to 12% of high volatile, bituminous coal dust.

5 Claims, No Drawings

DESULFURIZATION AGENT FOR FERROUS MELTS AND METHOD OF USING THE SAME

This invention relates to an improvement in desulfurization agents for ferrous melts, e.g., pig iron, cast iron and steel melts, and to an improved ferrous metal desulfurization process.

It is known from U.S. Pat. No. 3,598,573 that ferrous melts can be effectively desulfurized by treatment with a desulfurization agent comprising calcium carbide and a precipitated carbon-containing calcium carbonate known in industry as diamide lime formed as a by-product in an industrial process for manufacturing dicyandiamide. In accordance with this commercial process an aqueous calcium cyanamide suspension is treated with carbon dioxide to precipitate calcium carbonate in very finely divided form and intimately admixed with finely divided and co-precipitated carbon. The precipitate contains about 70% to 85% by weight of calcium carbonate, about 8% to 12% of carbon and minor proportions of impurities such as ferric oxide, aluminum oxide and silicon dioxide. As disclosed in U.S. Pat. No. 3,598,573, this diamide lime can be mixed to the extent of 2% to 40% with calcium carbide to form a mixture that is a good desulfurizing agent for ferrous metals.

The present invention is based on applicant's discovery that the desulfurizing agent of U.S. Pat. No. 3,598,573 can be substantially improved by admixing therewith finely divided bituminous coal, preferably a relatively high volatility bituminous coal. We were surprised to find that by incorporating a suitable amount of finely divided bituminous coal in the previously known mixture of calcium carbide and diamide lime, a desulfurizing agent is obtained which can be used in a smaller amount to produce a given desulfurization per ton of ore than the mixture of calcium cyanamide and diamide lime previously proposed as a desulfurizing agent.

While we do not wish to be bound by any particular theory as to why this improved result is obtained with the composition of the invention, it is our present understanding that this improved efficiency is due at least in part to the development of reducing gases upon heating of the bituminous coal powder, which reducing gases protect the carbides from burning in the oxidizing gases developed from the calcium carbonate and in this way result in an increased degree of utilization of the calcium carbide. A further advantage of the present desulfurizaton agent resides in the fact that to the extent that the bituminous coal is not consumed in its passage through the iron melt, it leaves a residue that is only carbon, which is not absorbed by the iron melt since the latter is already saturated in respect to carbon. The remaining carbon therefore retains the pulverulent form in which it was injected into the melt; it does not slag but burns harmlessly on the surface of the melt without developing irritating gases or gases that contaminate the environment. These results are attained without adverse effect on the previously described synergistic interaction of diamide lime and calcium carbide.

In general the present desulfurizing agent consists essentially of a mixture of calcium carbide, calcium carbonate containing finely divided carbon dispersed therein and from about 1% to 12% by weight of the mixture of finely divided bituminous coal, preferably a bituminous coal containing a relatively high proportion of volatile matter. The proportions of calcium carbide and diamide lime used are desirably similar to those disclosed in U.S. Pat. No. 3,598,573, i.e., a calcium carbide/diamide lime weight ratio of about 59:1 to 1.5:1. The preferred proportions of the several components of the desulfurizing agent are by weight 48% to 95% of calcium carbide, from about 2% to 40% of the carbon-containing calcium carbonate (diamide lime) and from about 1% to 12% of the coal dust. The resulting composition may have a total carbon content of about 5% to 12% by weight.

The present composition may be used in the same way as the previous calcium carbide/diamide lime desulfurizing agents. Because of its finely divided form, the desulfurizing agent may be added by blowing it into the melt or stirring it into the melt in a shaking ladle or dispersing it in the melt with a mechanical agitator. Basically introduction of the desulfurizing agent into the melt may be carried out in any manner known to be suitable for the addition of other pulverulent material to the melt either in the ladle or in the furnace.

The absolute amount of the desulfurizing agent to be added in accordance with the invention depends upon the initial sulfur content of the iron and the final sulfur content desired. With iron of the usual sulfur content, e.g., about 0.04% to 0.06%, an addition of sulfurizing agent of the order of about 0.5 to 2.5 kg per ton of ferrous metal per 0.01% desired reduction in sulfur will usually be required. On the average, the amount required is likely to be of the order of magnitude of 0.9 to 1 kg per ton of iron for removal of 0.01% of sulfur.

The desulfurizing agent of the invention is not only highly selective, but is also economical to employ. It constitutes an improvement over the calcium cyanamide/diamide lime desulfurizing agent of U.S. Pat. No. 3,598,573 in that a lesser amount of desulfurizing agent is required to produce a given desulfurization effect. Moreover, the amount of slag is even further reduced and thus the iron loss is also further reduced.

In order to point ot more fully the nature of the present invention, the following Example is given of a typical embodiment thereof.

EXAMPLE

60% of technical grade calcium carbide, 35% of dried diamide lime (a mixture of precipitated calcium carbonate with 10% of finely divided carbon dispersed therein) and 5% of dried bituminous coal powder were ground together in a tube mill to form a powder. The bituminous coal used had a 38% by weight volatile content.

This mixture was used to desulfurize pig iron employing the injecton technique. For this purpose an injection lance was introduced into the opening of a submarine ladle which contained about 185 tons of pig iron at a temperature of 1340° C. The desulfurizing agent was added to the melt at an average feed rate of 28 kg per minute and for injection of the powdered desulfurizing agent dry air was used at the rate of 11 liters (standard temperature and pressure) per kg of mixture fed. The sulfur content of the melt was decreased by this treatment from an average initial value of 0.048% to an average final value of 0.009%. To effect this reduction in sulfur content 3.6kg of desulfurizing agent was used per ton of pig iron.

For purposes of comparison a desulfurizing agent as disclosed in U.S. Pat. No. 3,598,573 comprising 60% of calcium carbide and 40% of diamide lime was used to desulfurize a similar bath. About 5.0 kg of desulfurizing agent per ton of pig iron was required in order to obtain the same degree of desulfurization as that obtained with the composition of the present invention.

It is of course to be understood that the foregoing description is intended to be illustrative only and that numerous changes can be made in the ingredients, proportions and conditions described without departing from the spirit of the invention as defined in the appended claims.

I claim:

1. A desulfurizing agent for ferrous metal melts consisting essentially of a mixture of calcium carbide, calcium carbonate containing finely divided carbon dispersed therein and from about 1% to 12% by weight of said mixture of coal dust.

2. A desulfurizing agent for ferrous metal melts consisting essentially of a mixture of calcium carbide, a carbon-containing calcium carbonate comprising about 70% to 85% by weight of calcium carbonate and about 8% to 12% by weight of finely divided carbon and coal dust in an amount to provide a composition having a total carbon content of about 5% to 12% by weight.

3. A desulfurizing agent according to claim 2 containing by weight from about 48% to 95% of calcium carbide, from about 2% to 40% of said carbon-containing calcium carbonate and from about 1% to 12% of said coal dust.

4. A process for desulfurizing a sulfur-containing ferrous melt which comprises treating said melt with from about 0.5 to 2.5 kg of a desulfurizing agent per ton of ferrous melt per 0.01% desired reduction in sulfur content, said desulfurization agent consisting essentially of a mixture of pulverulent calcium carbide, calcium carbonate containing finely divided carbon dispersed therein and coal dust.

5. A process according to claim 4 wherein said desulfurization agent consists essentially by weight of from about 48% to 95% of calcium carbide, from 2% to 40% of said carbon-containing calcium carbonate and from about 1% to 12% of said coal dust.

* * * * *